US005727077A

United States Patent [19]

Frasl

[11] Patent Number: 5,727,077

[45] Date of Patent: Mar. 10, 1998

[54] ELECTROACOUSTIC TRANSDUCER COMPRISING A CLOSING MEMBER

[75] Inventor: Ewald Frasl, Biedermannsdorf, Austria

[73] Assignee: U. S. Philips Corporation, New York, N.Y.

[21] Appl. No.: 772,189

[22] Filed: Dec. 20, 1996

Related U.S. Application Data

[63] Continuation of Ser. No. 378,905, Jan. 26, 1995, abandoned, which is a continuation of Ser. No. 67,203, May 25, 1993, abandoned.

[30] Foreign Application Priority Data

Feb. 26, 1993 [AT] Austria ..... A368/93

[51] Int. Cl.[6] ..... H04R 25/00

[52] U.S. Cl. ..... 381/192; 381/159; 381/201

[58] Field of Search ..... 381/192, 194, 381/199, 201, 183, 187, 88, 90, 25, 168, 169, 155; 367/174; 181/129, 128, 135; 387/159

[56] References Cited

U.S. PATENT DOCUMENTS

| | | | |
|---|---|---|---|
| 4,403,120 | 9/1983 | Yoshimi | 181/129 |
| 4,520,237 | 5/1985 | Murakami | 381/199 |
| 4,742,887 | 5/1988 | Yamaghishi | 381/154 |
| 5,150,419 | 9/1992 | Kizak et al. | 381/192 |
| 5,303,209 | 4/1994 | Frasl | 381/192 |
| 5,524,151 | 6/1996 | Bleim | 381/192 |

*Primary Examiner*—Huyen D. Le

*Attorney, Agent, or Firm*—Norman N. Spain

[57] ABSTRACT

In an electroacoustic transducer (1) having a diaphragm (5) and a partition (24) situated behind the diaphragm (5), which partition is traversed by partition openings (25, 26, 27, 28, 29, 30, 31, 32) to provide communication between a space (34) situated between the diaphragm (5) and one side (33) of the partition (24) and a space (36) situated at the other side (35) of the partition (24), a magnet system (16) situated at least partly within the space (36) at the other side (35) of the partition (24), and a closing member (44) for closing, at the back, the space (36) situated at the other side (35) of the partition (24), the closing member (44) has an opening (45) by which the closing member (44) is mounted on the outer circumferential surface (46) of the magnet system (16) with an acoustically sealed fit.

5 Claims, 1 Drawing Sheet

ELECTROACOUSTIC TRANSDUCER COMPRISING A CLOSING MEMBER

This is a continuation of application Ser. No. 08/378,905, filed Jan. 26, 1995, abandoned, which is a continuation of application Ser. No. 08/067,203, filed May 25, 1993, abandoned.

BACKGROUND OF THE INVENTION

The invention relates to an electroacoustic transducer having a diaphragm constructed to be capable of vibration parallel to a transducer axis, which transducer comprises a partition facing the back of the diaphragm, which partition substantially extends transversely of the transducer axis and is traversed by at least one partition opening to provide communication between a space situated between the diaphragm and one side of the partition and a space situated at the other side of the partition and partly bounded by a bounding part of the transducer, a magnet system situated at least partly within the space at the other side of the partition and having an outer circumferential surface which extends in the direction of the transducer axis, and a closing member arranged adjacent a portion of the magnet system which is remote from the partition, which closing member closes the space situated at the other side of the partition.

An electroacoustic transducer of the type defined in the opening paragraph is known and is manufactured and marketed by the applicant as a receiver/microphone capsule for telephony purposes under the type designation WD 10013/200. In the direction of the transducer axis the closing member of this known transducer is situated behind the end of the magnet system which is remote from the partition of the transducer. As a result, the electroacoustic transducer has a comparatively large mounting depth in the direction of the transducer axis, which in several currently used apparatuses comprising such a transducer, such as telecommunication apparatuses, leads to space problems, because such apparatuses are often required to be very flat and consequently do not have much space to accommodate the electroacoustic transducer.

SUMMARY OF THE INVENTION

It is an object of the invention to improve the construction of an electroacoustic transducer of the type defined in the opening paragraph so as to minimize the mounting depth in the direction of the transducer axis. To this end the invention is characterized in that the closing member has an opening by which the closing member is mounted on the outer circumferential surface of the magnet system with an acoustically sealed fit, and the closing member has a peripheral portion surrounding the opening, by which the closing member is connected to the bounding part in an acoustically sealed and mechanically rigid manner. In this way it is achieved that relative to the transducer axis the closing member of the transducer is situated within the axial boundaries of the magnet system of the transducer, i.e. requires no additional space in the direction of the transducer axis. This leads to a very small mounting depth of a transducer in accordance with the invention, so that such a transducer is also suitable for mounting in very flat apparatuses.

At the location of its opening the closing member may be glued to the outer circumference of the magnet system. However, it is found to be particularly advantageous if the closing member is connected to the outer circumferential surface of the magnet system only by means of a mechanical fit. This results in a very simple acoustically closed mechanical connection between the closing member and the outer circumference of the magnet system.

For the magnet system different known magnet-systems may be used, for example a ring-magnet system embedded in a synthetic resin. However, in this connection it is found to be particularly advantageous if the magnet system is constituted by a pot-core magnet system having a circularly cylindrical outer circumferential surface, and the closing member has a circular opening. This is particularly advantageous for the implementation of a transducer in accordance with the invention as a receiver/microphone capsule for small telecommunication apparatuses because such a pot-core magnet system can be of very compact construction.

BRIEF DESCRIPTION OF THE DRAWINGS

The invention will now be described in more detail with reference to the drawing, which shows an exemplary embodiment to which the invention is not limited.

DETAILED DESCRIPTION OF THE PREFERRED EMBODIMENTS

Figure 1:
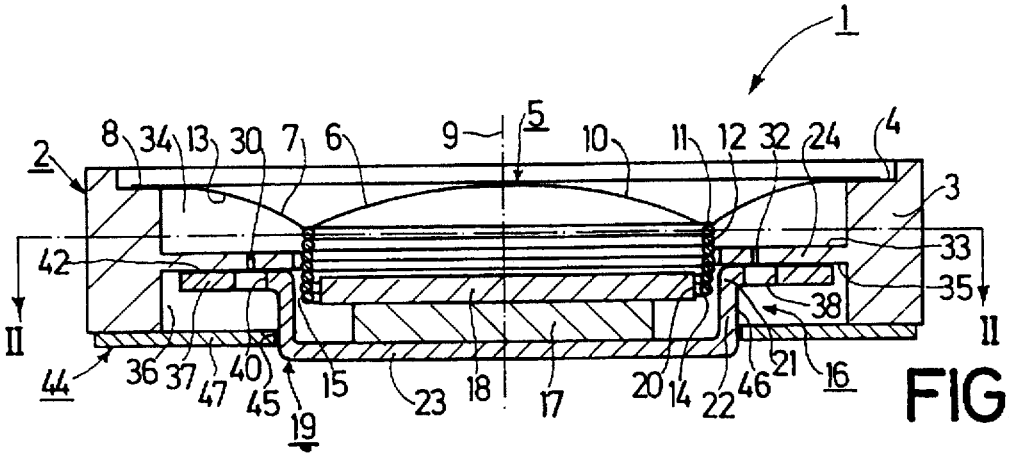
FIG. 1 is a slightly diagrammatical cross-sectional view, taken on the line I—I in FIG. 2 and to a larger than full-size scale, showing an electrodynamic transducer embodying the invention, constructed as a receiver/microphone capsule for telecommunication purposes and comprising a pot-core magnet system, on whose pot-shaped magnet-system a closing member formed by an annular disc is mounted.
Figure 2:
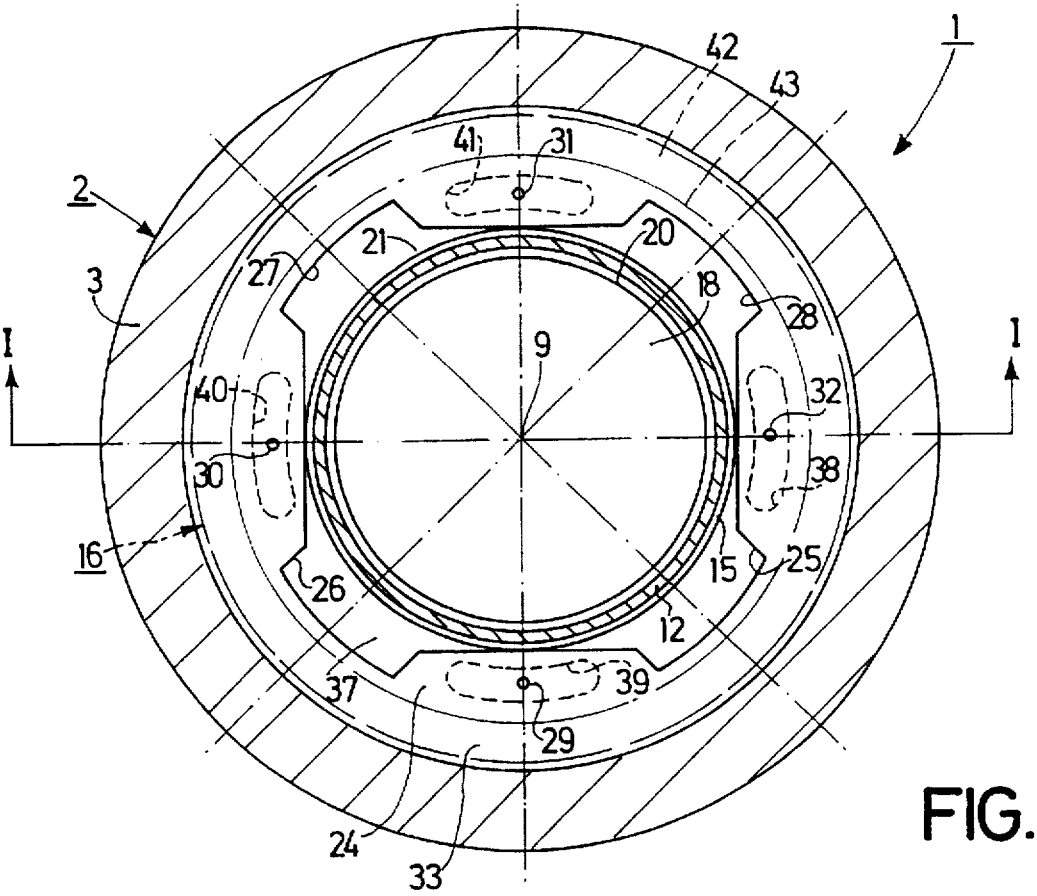
FIG. 2 shows the transducer in a sectional view taken on the line II—II in FIG. 1.

FIGS. 1 and 2 show an electrodynamic transducer 1 constructed as a receiver/microphone capsule. The transducer 1 has an essentially annular or hollow cylindrical mounting device 2. The mounting device 2 has a cylindrical outer wall 3 having a stepped portion 4 in its area facing a front side of the transducer 1. The stepped portion 4 forms a mounting zone to which a diaphragm 5 of the transducer 1 is secured by an adhesive joint. The diaphragm 5 has a central portion 6, which is often referred to as a dome. The diaphragm 5 further has a peripheral portion 7 provided with hyperbolic corrugations, not shown in FIG. 1. With the outer edge 8 of the peripheral portion 7 the diaphragm 5 is connected to the stepped portion 4 of the mounting device 2 by an adhesive. The diaphragm 5 is constructed to allow back and forth vibration parallel to a transducer axis 9 and from its front side 10 it emits useful waves which are audible in operation.

In the transitional area 11 between the central portion 6 and the peripheral portion 7 of the diaphragm 5 a moving coil 12 is connected to the diaphragm 5 by an adhesive joint. In the present case the moving coil 12 projects into an air gap 15 of a magnet system 16 of the transducer 1 with its part 14 which is remote from the back 13 of the diaphragm. The magnet system 16 comprises a magnet 17, a pole plate 18, and a pot 19, which is often also referred to as outer pot. The air gap 15, in which the part 14 of the moving coil 12 is disposed, is situated between the circumferential bounding surface 20 of the pole plate 18 and the periphery 21 of the hollow cylindrical portion 22, which is closed by the bottom portion 23 of the pot 19.

In the present transducer 1 the mounting device 2 comprises a substantially annular partition 24, which projects radially inward from the outer wall 3 and which faces the back 13 of the diaphragm 5 and extends transversely of the transducer axis 9. The partition 24 has four partition openings 25, 26, 27, 28 and 29 of substantially slot-shaped cross-section, which traverse the partition 24 and which are equispaced at angles of 90° from one another. The partition 24 further has four partition openings 29, 30, 31 and 32 of circular cross-section, which also traverse the partition 24 and which are equispaced at angles of 90° from one another and spaced at angles of 45° from the respective slot-shaped partition openings 25, 26, 27 and 28. The partition openings 25, 26, 27, 28 and 29, 30, 31, 32 serve to provide communication between a space 34 situated between the diaphragm 5 and one side 33 of the partition 24 and a space 36 at the other side 35 of the partition 24. In the electrodynamic transducer 1 constructed as a capsule, as shown in FIGS. 1 and 2, the space 36 is closed at the back of the transducer 1, as will be described in more detail hereinafter. The slot-shaped partition openings 25, 26, 27 and 28 may have a length of, for example, approximately 6 mm. It is found to be advantageous if the circular partition openings 29, 30, 31 and 32 have a diameter smaller than 0.3 mm and preferably 0.2 mm. However, alternatively the circular partition openings may have a diameter of, for example, only 50 or 40 μm. In the present transducer 1 shown in FIGS. 1 and 2 the circular partition openings 29, 30, 31 and 32 are cylindrical in the axial direction.

The transducer 1 further comprises a mask 37 arranged adjacent the side 35 of the partition 24 and in the present case adjoining the partition 24. The mask 37 has four mask openings 38, 39, 40 and 41 of slot-shaped cross-section, which traverse the mask 37 and which are equispaced at angles of 90° from one another to provide communication between the two spaces 34 and 36. The slot-shaped openings 38, 39, 40 and 41 may have a length of approximately 5 mm and a width of approximately 2.2 mm.

In order to obtain different acoustically active cross-sectional areas of the communication paths between the two spaces 34 and 36, which communication paths are provided by the openings 25, 26, 27, 28 and 29, 30, 31, 32 in the partition 24 and 38, 39, 40, 41 in the mask 37, which openings can be made to coincide in the direction of the transducer axis 9, the partition 24 and the mask 37 can be brought into and fixed in two mutually displaced positions relative to the transducer axis 9. In the transducer 1 in the form of a capsule, as shown in FIGS. 1 and 2, the partition 24 and the mask 37 have been brought into and fixed in such a position relative to one another that the partition openings 29, 30, 31, 32 coincide with the mask openings 38, 39, 40, 41. At the location of two coincident openings this results in a very small acoustically active cross-section area of the respective communication path between the two spaces 34 and 36, which is defined exactly by the cross-sectional area of the circular partition openings 29, 30, 31 and 32 and which is required in order to realize a transducer capsule and the desired frequency response for such a capsule.

As can be seen in FIGS. 1 and 2, the pot 19 of the magnet system 16 in the transducer 1 has a flange 37 which extends transversely of the transducer axis 9 and by which the pot 19 is glued to the partition 24, in order to secure the entire magnet system 16, along a continuous substantially circular adhesive joint 42, which is situated in the outer area of the flange 37 and whose inner boundary 43 is represented diagrammatically as a dash-dot line in FIG. 2. It is obvious that in practice such an adhesive joint 42 obviously does not have such an exactly circular boundary 43.

The flange 37 of the pot 19 of the magnet system 16 constitutes not only a fixing element for securing the magnet system 16 to the mounting device 2 but, in a very simple and very advantageous manner, also the mask 37 of the transducer 1. Thus, it is achieved that the mask 37 of the transducer 1 is not formed by a separate part but by a portion of a part of the transducer 1 which is present anyway, i.e. by the flange 37 of the pot 19 of the magnet system 16 of the transducer 1. This has the advantage that parts costs are reduced and, in particular, that the number of assembly steps and the assembly costs are minimized. A minimal number of assembly steps and minimal assembly costs are of great significance for the mass production of such an electrodynamic transducer 1 because this enables a simpler assembly line to be used. Moreover, no additional tolerance effects are introduced by constructing the flange of the pot as a mask, which is favourable for a good reproducibility of the acoustic characteristics of the transducer 1.

In the electrodynamic transducer 1, shown in FIGS. 1 and 2, constructed as a capsule for telecommunication purposes, particularly telephony purposes, the space 36 at the other side 35 of the partition 24 is closed, as already stated above. There is provided a plate-shaped closing member 44 for closing the space 36. The closing member 44 has an opening 45, in the present case of circular cross-section, by which the closing member is mounted on the outer circumferential surface 46 of the pot 19 of the magnet system 16 with an acoustically sealed fit. The closing member 44 has a peripheral portion 47 surrounding the opening 45, by which the closing member 44 is connected to the outer wall 3 of the mounting device 2 in an acoustically sealed and mechanically rigid manner. The mounting device 2, i.e. its outer wall 3, thus constitutes a part bounding the space 36 in the present transducer 1. The mounting device 2 and the closing member 44 are made of the same synthetic material and are mechanically secured to one another by ultrasonic welding. At the location of the opening 45 the closing member 44 is connected very simply to the outer circumferential surface 46 of the pot 19 of the magnet system 16 only by means of a mechanical press fit.

In the transducer 1 shown in FIGS. 1 and 2 the partition 24 and the mask 37 can also be brought into and held in another position relative to one another than shown in FIGS. 1 and 2. In the transducer 1 shown in FIGS. 1 and 2 the partition 24 and the mask 37, i.e. the flange 37 of the pot 19 of the magnet system 16, can be brought into and held in a position relative to one another in which the slot-shaped partition openings 25, 26, 27 and 28 coincide with the slot-shaped mask openings 38, 39, 40 and 41. At the location of two coincident openings this results in a large acoustically active cross-sectional area of the relevant communication path between the two spaces 34 and 36, which is defined exactly by the cross-sectional area of the mask openings 38, 39, 40 and 41 and which is required in order to realize a transducer constructed as a loudspeaker and the desired frequency response for such a loudspeaker. In such a transducer 1 constructed as a loudspeaker the space 36 is then open by omitting the closing member 44.

In the transducer 1 in accordance with the invention shown in FIGS. 1 and 2 it is achieved in a particularly simple manner that relative to the transducer axis 9 the closing member 44 of the transducer 1 is situated within the axial boundaries of the magnet system 16 of the transducer 1, i.e. requires no additional space in the direction of the transducer axis 9. This leads to a very small mounting depth of the transducer 1 in the direction of its transducer axis 9, so that such a transducer 1 is also suitable for mounting in very flat telecommunication apparatuses.

The invention is not limited to the exemplary embodiment of the transducer described hereinbefore. For example, the flange of the pot of a pot-core magnet system as used in the transducer described herein, which flange serves as a mask, may also adjoin a partition of such a mounting device at the side facing the diaphragm. In a transducer in accordance with the invention it is also possible to use another magnet system than a pot-core magnet system. Moreover, the partition may have, for example, more than two different types of partition openings, which can be made to coincide with, for example, more than one type of mask openings in a mask formed by a flange in different positions of the partition and the mask relative to one another. Instead of providing only one circular opening of small diameter in a part of the partition it is also possible to provide two or more of such circular openings of even smaller diameter. Such openings of circular cross-section may have a conical shape instead of a cylindrical shape in the axial direction.

I claim:

1. An electroacoustic transducer comprising:

a cylindrical mounting device having an outer wall, a lower wall and an inwardly disposed flange having a central opening;

a diaphragm capable of motion in a direction parallel to the transducer axis;

a voice coil coupled to said diaphragm and extending at least partially through the central opening in the inwardly disposed flange of the cylindrical mounting device;

a magnet mounting device having an annular flange extending transversely to said transducer axis, an outer circumferential surface extending along said transducer axis and a magnet mounting surface extending transversely to said outer circumferential surface, said annular flange being secured to the inwardly disposed flange of the mounting device;

magnet means mounted to said magnet mounting device so as to be proximate to said voice coil; and a closure plate having an aperture sized to tightly receive said magnet mounting means, said closure plate being disposed such that it extends between said lower surface of said cylindrical mounting device and said magnet mounting device to provide an acoustic seal therebetween.

2. The electroacoustic transducer as claimed in claim 1 wherein the inwardly disposed flange of said cylindrical mounting device and said flange of said magnet mounting device have apertures which are in cooperation with each other when said devices are joined together.

3. An electroacoustic transducer having a diaphragm constructed to be capable of vibration parallel to a transducer axis, which transducer comprises a partition facing the back of the diaphragm, which partition substantially extends transversely of the transducer axis and is traversed by at least one partition opening to provide communication between a space situated between the diaphragm and one side of the partition and a space situated at the other side of the partition and partly bounded by a bounding part of the transducer, a magnet system situated at least partially within the space at the other side of partition and having a cylindrical outer circumferential surface which extends in the direction of the transducer axis, and a plate-shaped closing member arranged adjacent a portion of the magnet system which is remote from the partition, which closing member closes the space situated at the other side of the partition and has an opening by which the plate-shaped closing member is mounted on the cylindrical outer circumferential surface of the magnet system with an acoustically sealed fit, and which closing member further has a peripheral portion surrounding the opening, by which the plate-shaped closing member is connected to the bounding part in an acoustically sealed and mechanically rigid manner.

4. A transducer as claimed in claim 3, wherein the plate-shaped closing member is connected to the cylindrical outer circumferential surface of the magnet system only by means of a mechanical fit.

5. A transducer as claimed in claim 3, wherein the magnet system is a pot-core magnet system whereby the cylindrical outer circumferential surface is a circularly cylindrical surface and the opening in the plate-shaped closing is a circular opening.

* * * * *